US011239580B2

(12) United States Patent
Hoffmann

(10) Patent No.: US 11,239,580 B2
(45) Date of Patent: Feb. 1, 2022

(54) PLUG-IN CONNECTION ARRANGEMENT FOR AN ELECTRICAL TERMINAL BLOCK

(71) Applicant: Phoenix Contact GmbH & Co. KG, Blomberg (DE)

(72) Inventor: Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 17/050,060

(22) PCT Filed: Apr. 10, 2019

(86) PCT No.: PCT/EP2019/059099
§ 371 (c)(1),
(2) Date: Oct. 23, 2020

(87) PCT Pub. No.: WO2019/206636
PCT Pub. Date: Oct. 31, 2019

(65) Prior Publication Data

US 2021/0075132 A1 Mar. 11, 2021

(30) Foreign Application Priority Data

Apr. 24, 2018 (DE) ..... 10 2018 109 861.8

(51) Int. Cl.
*H01R 9/22* (2006.01)
*H01R 9/26* (2006.01)
*H01R 9/24* (2006.01)

(52) U.S. Cl.
CPC ..... *H01R 9/2633* (2013.01); *H01R 9/2433* (2013.01); *H01R 9/2441* (2013.01)

(58) Field of Classification Search
CPC ..... H01R 4/48; H01R 9/22; H01R 9/2633; H01R 9/2433; H01R 9/2441; H01R 9/26;
(Continued)

(56) References Cited

U.S. PATENT DOCUMENTS 3,602,586 A * 8/1971 Bartl ..... G03B 19/18 352/243
4,687,270 A * 8/1987 Plyler ..... H01H 85/0208 361/833

(Continued)

FOREIGN PATENT DOCUMENTS

CN 203607560 U 5/2014
CN 106030915 A 10/2016

(Continued)

OTHER PUBLICATIONS

Norm DIN EN 60664-1:2007 Jan. 1, 2008; German Version; "Isolationskoordination für elektrische Betriebsmittel in Niederspannungsanlagen—Teil 1: Grundsätze, Anforderungen und Prüfun"; pp. 1, 43-49.

(Continued)

*Primary Examiner* — William H. Mayo, III
(74) *Attorney, Agent, or Firm* — Holland & Hart LLP

(57) ABSTRACT

A plug-in connection arrangement for arranging a relay includes a terminal block comprising a relay holder configured to hold a relay. The relay has a bottom wall, a side wall, and a contact plug which projects out of the bottom wall. The side wall is arranged perpendicular to the bottom wall and includes an offset section which contacts the bottom wall and projects out into the relay in a direction of a surface normal of the side wall. The relay holder includes a socket configured to hold the contact plug of the relay when the relay is inserted into the relay holder. The relay holder also includes an insulating wall which, when the relay is inserted into the relay holder, is aligned parallel to the side wall and projects beyond the bottom wall to form an angled insulation section for the contact plug along a surface of the insulating wall.

16 Claims, 10 Drawing Sheets

(58) Field of Classification Search
CPC .. H01R 9/2675; H01R 9/2408; H01R 9/2491; H01B 1/20
USPC ..... 439/417, 441, 709, 712, 714, 716, 721, 439/723, 724, 789, 796, 828, 835, 838; 361/94, 601, 627, 629, 637–640, 716, 361/721–724, 822–823
See application file for complete search history.

(56) References Cited

U.S. PATENT DOCUMENTS 4,758,186 A * 7/1988 Barriuso ..... H01R 4/363 439/723
4,826,439 A * 5/1989 Lau ..... H01R 33/20 439/56
4,846,733 A * 7/1989 Baisz ..... H01H 85/2035 439/620.33
4,929,186 A * 5/1990 Steinkuhle ..... H01R 12/515 439/717
5,049,094 A * 9/1991 Heng ..... H02B 1/052 439/716
5,090,922 A * 2/1992 Rymer ..... H01R 9/2608 439/716
5,145,417 A * 9/1992 Honkomp ..... H01R 13/68 439/502
5,208,525 A * 5/1993 Lopic ..... B25F 5/02 320/112
5,224,881 A * 7/1993 Lejuste ..... H01R 9/2441 361/119
5,299,957 A * 4/1994 Schaeffer ..... H01H 11/0031 439/712
5,318,461 A * 6/1994 Frikkee ..... H01R 9/2625 361/119
5,356,303 A * 10/1994 Shibata ..... H01R 13/52 439/184
5,411,417 A * 5/1995 Horn ..... H01R 9/2641 439/709
5,588,881 A * 12/1996 Eggert ..... H01R 9/2633 439/709
5,658,172 A * 8/1997 Schmidt ..... H01R 9/2491 439/716
7,658,653 B2 * 2/2010 Diekmann ..... H01H 85/2045 439/715
2008/0261426 A1 * 10/2008 Diekmann ..... H01R 9/265 439/189
2010/0017876 A1 1/2010 Chusing et al.
2012/0081827 A1 4/2012 Gillespie et al.

FOREIGN PATENT DOCUMENTS

| | | | |
|---|---|---|---|
| CN | 106471678 | A | 3/2017 |
| DE | 29 14 192 | C2 | 10/1980 |
| DE | 20 2011 000 834 | U1 | 11/2011 |
| DE | 20 2014 000 905 | U1 | 2/2014 |
| DE | 102016112663 | A1 | 1/2018 |
| JP | 4814592 | B1 | 5/1973 |
| JP | H07230839 | A | 8/1995 |
| JP | 2006179311 | A | 7/2006 |
| JP | 4814592 | B2 | 11/2011 |

OTHER PUBLICATIONS

Notice of Reasons for Refusal; JP Application No. 2020-555428; dated Nov. 19, 2021; 6 pgs.

* cited by examiner

PLUG-IN CONNECTION ARRANGEMENT FOR AN ELECTRICAL TERMINAL BLOCK

CROSS-REFERENCE TO RELATED APPLICATIONS

The present application is the national phase entry under 35 U.S.C. 371 of International Patent Application No. PCT/EP2019/059099 by Hoffmann, entitled "PLUG-IN CONNECTION ARRANGEMENT FOR AN ELECTRICAL TERMINAL BLOCK," filed Apr. 10, 2019; and claims the benefit of German Patent Application No. 10 2018 109 861.8 by Hoffmann, entitled "STECKVERBINDUNGSANORDNUNG FÜR EINE REIHENKLEMME," filed Apr. 24, 2018, each of which is assigned to the assignee hereof and is incorporated by reference in its entirety.

FIELD OF THE DISCLOSURE

The present disclosure relates to a plug-in connection arrangement for arranging a relay in an electrical terminal block.

BACKGROUND

A combination of several electrical terminal blocks typically has a plurality of adjacent plug-in connections for electrical components, in particular relays. The distance between connection contacts and electrical components arranged next to one another can accordingly be determined by a distance between the plug-in connections. Advantageously, the overall width of the electrical terminal blocks and thus the distance between the plug-in connections is reduced in order to reduce the space required by the combination of several electrical terminal blocks. In contrast, it may be necessary to maintain a minimum distance between the connection contacts in order to prevent an electrical connection, in particular due to spark formation and/or leakage currents between the connection contacts. Correspondingly, a further reduction in the overall width of the electrical terminal blocks can be limited in a disadvantageous manner due to the necessary minimum spacing between the connection contacts.

SUMMARY

It is the object of the present disclosure to provide a more efficient plug-in connection arrangement with a reduced overall width and lengthened and/or at least constant insulation distances.

This object is achieved by the features of the independent claims. Advantageous examples are the subject matter of the dependent claims, the description and the accompanying figures.

The present disclosure is based on the knowledge that the above object can be achieved by a plug-in connection arrangement which has an angled design of the insulation and/or creepage distances. The plug-in connection arrangement comprises a relay, which forms a plug, and a relay holder, which forms a socket. On the side next to a contact plug, the relay has a trough-shaped recess into which an insulating wall of the relay holder engages. Correspondingly, a step-shaped gap is formed, which increases an insulation section between plug-in connections arranged next to one another by at least twice the height of the trough-shaped recess. By reducing the overall width of the electrical terminal block, the insulation distance can be reduced again, so that with the angled formation of the insulation distance, the insulation distance is not smaller than an insulation distance of a wider electrical terminal block without an angled formation of the insulation distance.

According to a first aspect, the disclosure relates to a plug-in connection arrangement for arranging a relay in an electrical terminal block, wherein the relay has a bottom wall, a side wall and a contact plug which projects out of the bottom wall. The side wall is arranged perpendicular on the bottom wall and has an offset section which contacts the bottom wall and projects out into the relay in the direction of a surface normal of the side wall. The electrical terminal block has a relay holder which is adapted to hold the relay, wherein the relay holder has a socket which is adapted to hold the contact plug when the relay is inserted into the relay holder. The relay holder further has an insulating wall which, when the relay is inserted into the relay holder, is aligned parallel to the side wall and projects beyond the bottom wall to form an angled insulation section for the contact plug along a surface of the insulating wall.

The plug-in connection arrangement is in particular adapted to mechanically fix an electrical component, in particular a relay, which is arranged in a component housing by means of an at least partial form-fit connection. Furthermore, the plug-in connection is adapted to produce an electrical connection between the electrical component and the electrical terminal block. The offset section forms a trough-shaped recess, in particular a cuboid recess, which can at least partially hold the insulating wall.

In particular, the relay can be L-shaped on the bottom side and the relay holder can also be shaped L-shaped, inversely to the relay shape on the bottom, so that the relay can at least partially come to rest on the relay holder with a form fit.

In one example, the insulating wall at least partially engages in the offset section in order to reduce a width of the plug-in connection arrangement.

This has the advantage that the relay can be used with a reduced overall width but with a constant insulation distance in an electrical terminal block with a reduced overall width. For example, the relay can have a minimum insulation distance which is greater than the overall width of the electrical terminal block or relay holder. It may therefore be necessary to find a geometric arrangement that allows an isolation section to be realized between two adjacent relays, which is greater than the directly measured distance between the relays. This can be achieved in particular by an angled guidance of the insulation sections, wherein the required installation space for an angled insulation section can be larger than a direct, flat insulation section. In order to provide the possibly increased installation space, the offset section is formed in the relay. Advantageously, only one contact fastening and/or a housing outlet of the contact plug of the relay are provided in the area of the offset section, so that the formation of the offset section in the relay does not result in any restriction for electrical and/or mechanical components arranged within the relay. In particular, the relay in this adaptation can be mounted on printed circuit boards without restrictions.

With the offset section, the installation space provided for holding a relay in the electrical terminal block can be used more efficiently, in that an insulation section can be realized with a smaller overall width with at least the same or increased overall length of the insulation section. The installation space for the isolation section can increase in the direction of the installation height of the relay, wherein this otherwise unused vertical installation space is able to be used efficiently to increase the packing density of relays inserted into side-by-side arranged electrical terminal blocks.

In one example, the insulating wall has a side wall surface and a top surface, wherein the side wall surface faces the side wall and is spaced apart from the offset section, and wherein the top surface comes to bear at least partially on the offset section.

The insulating wall can be spaced from the relay in order to create an air gap as an insulating section. When the relay rests on the relay holder, a contact surface of the relay housing on the relay holder can form a leaking path for the contact plug.

In one example, the relay holder has a front guide rail and/or a rear guide rail in which the relay at least partially engages, wherein the front guide rail and/or the rear guide rail is adapted to guide the relay along an insertion direction to the socket in order to realize a superimposed alignment of the contact plug to the socket. This has the advantage that the contact plug can be inserted precisely into the socket. In particular with a plurality of contact plugs and sockets, polarity reversal of the contact plugs and/or an offset insertion of the relay into the relay holder can thus be prevented.

In one example, the front guide rail and/or the rear guide rail each have a U-shaped profile which is adapted to form a form-fit connection with the relay after and/or during the insertion of the relay into the relay holder. This has the advantage that manual or mechanical insertion of the relay into the electrical terminal block can be simplified. In particular, tilting or misalignment of the contact plug in relation to the socket can be prevented. The guide rails can also have an anti-twist device, wherein the front guide rail has, for example, a different rail width with respect to the rear guide rail, or a differently shaped additional guide web. The guide rails can also form a delimitation of the relay at the end faces of the relay and at least partially encompass the relay at the end faces so that the guide rails can come to rest on the side walls of the relay.

In one example, a section length of the offset section is smaller than a relay length of the relay. This has the advantage that the insulating wall and the offset section are formed in the area of the contact plug to be insulated. The remaining part of the relay can use the full width of the electrical terminal block. In particular in the area of a magnetic release system arranged in the relay housing, it does not overlap with the offset section. In particular, switching contacts of the relay can be isolated in the direction of adjacent switching contacts of other relays by means of the insulating wall. The connection contacts for controlling the relay tripping system can have lower requirements, in particular lower insulation and leaking distances to be observed, so that an extension of the insulation distance in the area of the connection contacts of the relay may not be necessary.

In one example, a wall length of the insulating wall is smaller than the section length and the insulating wall is adapted to form a form-fit connection with the offset section. This has the advantage that the insulating wall can be arranged completely in the offset section. In particular, the insulating wall forms a flat and/or gap-free surface with the side wall of the relay. The form-fit connection prevents the relay from being offset in the direction of the wall length. A gap between the insulating wall and the side wall can be an indicator for checking the position of the relay in the relay holder in order to ensure complete insertion of the relay into the relay holder.

In one example, the plug-in connection arrangement comprises an end plate which is arranged laterally on the relay holder and at least partially rests on an outer wall of the relay opposite the side wall and/or faces the outer wall in order to provide contact insulation and/or protection against contact of the contact plug. This has the advantage that the respective first relay in an arrangement of a plurality of electrical terminal blocks has sufficiently large insulation and/or leaking distances with respect to adjacent electronic components. The end plate can be adapted in accordance with the shape of the electrical terminal block and at least partially covers an outer wall of the relay.

In one example, the plug-in connection arrangement comprises a plurality of contact plugs which are arranged in a row and project out from the bottom wall, wherein a first number of the contact plugs form connection contacts of the relay and a second number of the contact plugs form switching contacts of the relay, and wherein the insulating wall extends along the switching contacts. The relay can in particular have two, three or four switching contacts which can be connected in pairs or alternately in an electrically conductive manner. Furthermore, the relay can have at least two connection contacts for controlling the magnetic release system. The majority of the contact plugs can advantageously only form a single row in order to realize a spaced arrangement of the contact plugs in the direction of the relay overall length of the relay, so that a spaced arrangement in the direction of the overall width of the relay, such as in a two-row arrangement, may not be necessary.

The distances between the contact plugs can in particular correspond to a standardized pattern in order to ensure a high level of compatibility with existing relay assemblies.

In one example, a wall height of the insulating wall exceeds a section height of the offset section in order to arrange the bottom wall at a distance from the relay holder after the relay has been inserted into the relay holder.

On the side wall, spacers can also be formed in an area outside the offset section, which are adapted to compensate for a height difference, when the relay is inserted into the relay holder, with the insulating wall, which is elevated compared to the section height, in order to prevent a leverage effect along a longitudinal axis of the relay after insertion into the relay holder.

The relay holder can furthermore have a circumferential wall which comprises the insulating wall and/or the front or rear guide rail. The circumferential wall can completely enclose the relay at the bottom in order to realize a contact protection of the contact plugs of the relay.

In one example, the insulating wall is offset in the direction of a surface normal of the side wall relative to the side wall in order to form a cavity between the offset section and the insulating wall. The cavity can in particular be part of an insulation section between contact plugs of adjacent relays. With a change in a width of the insulation wall, a width of the cavity can be adapted.

In one example, the relay holder has a support plate in which the socket is arranged, wherein the support plate is formed in one piece with the insulating wall.

In one example, the relay has a contact insulation wall which is arranged parallel to the side wall and at least partially projects beyond the bottom wall, wherein the relay holder has a receiving niche which, when the relay is inserted into the relay holder, is aligned parallel to the side wall, and is adapted to at least partially hold the contact insulation wall in order to form an angled insulation section for the contact plug along a surface of the contact insulation wall.

According to a second aspect, the disclosure relates to an electrical terminal block arrangement with a plurality of electrical terminal blocks which respectively have a plug-in connection arrangement, wherein each respective electrical terminal block is adapted to hold a relay, wherein the respective relay has a bottom wall, a side wall and a contact plug which projects out of the bottom wall, wherein the side wall is arranged perpendicular on the bottom wall and has an offset section which contacts the bottom wall and projects out in the relay in the direction of a surface normal of the side wall, wherein the respective electrical terminal block has a relay holder which is adapted to hold the respective relay, wherein the relay holder has a socket, which is adapted to hold the contact plug when the respective relay is inserted into the relay holder, and wherein the relay holder further has an insulating wall, which, when the respective relay is inserted into the relay holder, is aligned parallel to the side wall and projects beyond the bottom wall in order to form an angled insulation section for the contact plug along one surface of the insulating wall, wherein the electrical terminal blocks are congruent next to each other.

In one example, an insulating wall of a plug-in connection arrangement of a first electrical terminal block of the plurality of electrical terminal blocks is arranged next to an outer wall of a further plug-in connection arrangement of a second electrical terminal block of the plurality of electrical terminal blocks and faces the outer wall, wherein a gap is formed between the insulating wall and the outer wall.

In one example, a gap between the offset section, the insulating wall of the first electrical terminal block and a further outer wall of the second electrical terminal block forms a multi-angled insulation section between the contact plug of the plug-in connection arrangement of the first electrical terminal block and the further contact plug of the second electrical terminal block.

BRIEF DESCRIPTION OF THE DRAWINGS

Further examples are explained with reference to the accompanying figures. They show.

DETAILED DESCRIPTION

Figure 1:
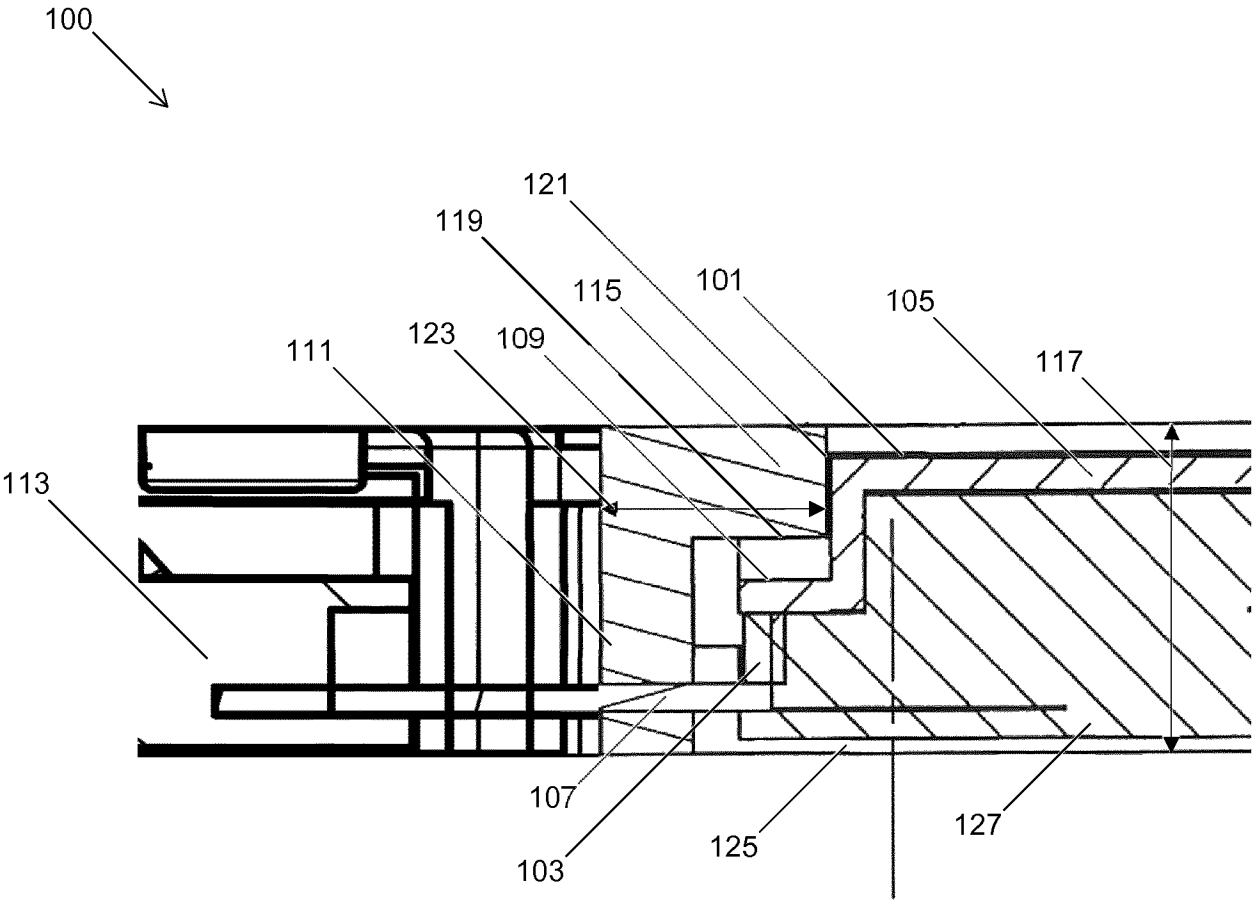
FIG. 1 shows a plug-in connection arrangement in an example.

FIG. 1 shows a schematic cross-sectional view of a plug-in connection arrangement 100 for arranging a relay 101 in an electrical terminal block. The relay 101 has a bottom wall 103, a side wall 105 and a contact plug 107 which projects out of the bottom wall 103. The side wall 105 is arranged perpendicular on the bottom wall 103 and has an offset section 109 which contacts the bottom wall 103 and projects out into the relay 101 in the direction of a surface normal of the side wall 105.

The electrical terminal block has a relay holder 111 which is adapted to hold the relay 101, the relay holder 111 having a socket 113 which is adapted to hold the contact plug 107 when the relay 101 is inserted into the relay holder 111.

The relay holder 111 also has an insulating wall 115 which, when the relay 101 is inserted into the relay holder 111, is aligned parallel to the side wall 105 and projects beyond the bottom wall 103 in order to form an angled insulation section for the contact plug 107 along a surface of the insulating wall 115.

The insulating wall 115 at least partially engages in the offset section 109 in order to reduce a width 117 of the plug-in connection arrangement 100. Furthermore, the insulating wall 115 has a side wall surface 119 and a top surface 121, wherein the side wall surface 119 faces the side wall 105 and is at a distance from the offset section 109, and wherein the top surface 121 comes to bear at least partially on the offset section 109. Furthermore, the insulating wall 115 is offset 105 with respect to the side wall 105 in the direction of a surface normal of the side wall in order to form a cavity between the offset section 109 and the insulating wall 115.

Furthermore, a wall height 123 of the insulating wall 115 exceeds a section height of the offset section 109 in order to arrange the bottom wall 103 at a distance from the relay holder 111 after the relay 101 has been inserted into the relay holder 111

Figure 2:
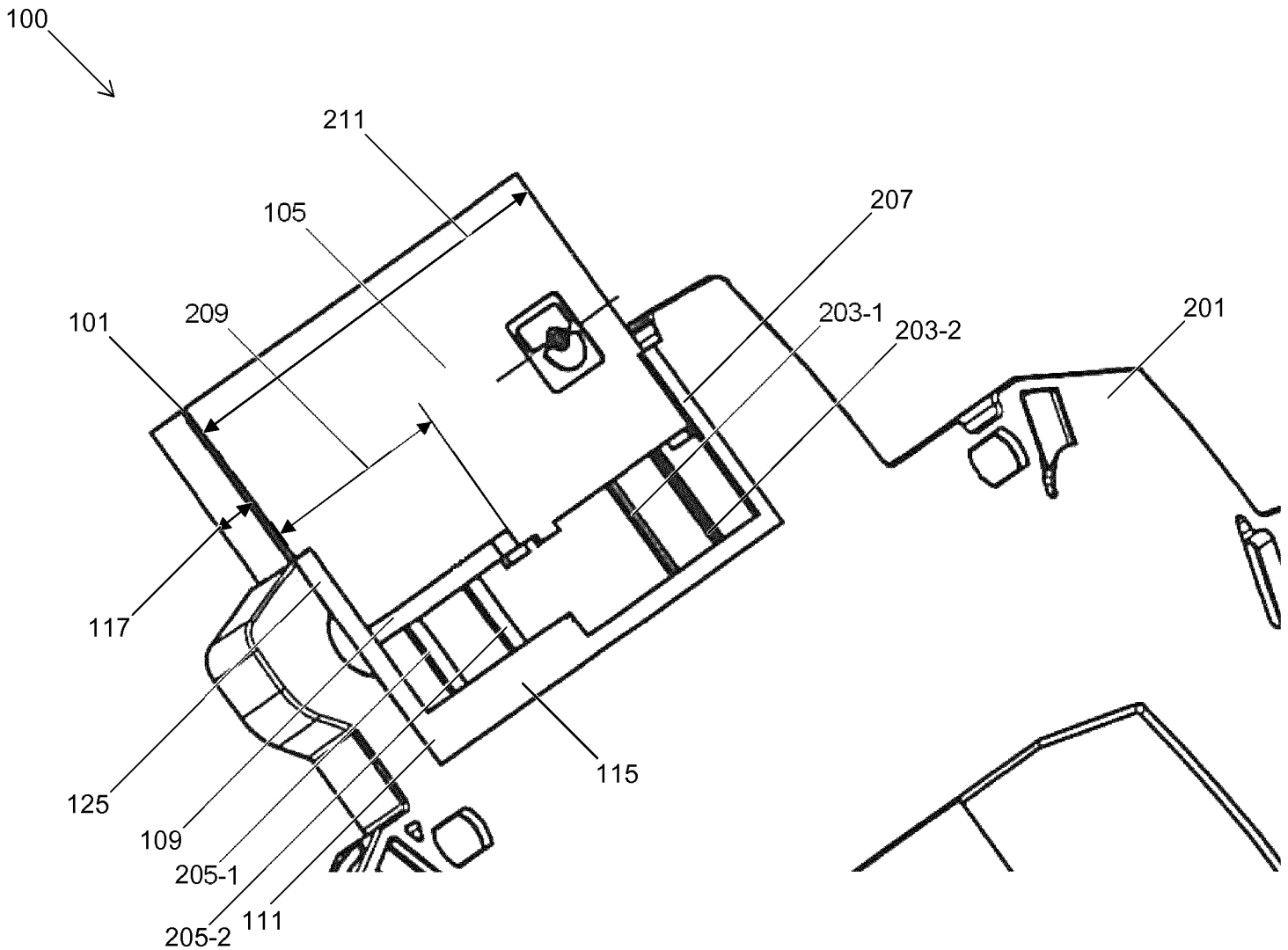
FIG. 2 shows a plug-in connection arrangement in an example.

FIG. 2 shows a schematic perspective view of the plug-in connection arrangement 100 according to the example shown in FIG. 1. The plug-in connection arrangement 100 is part of an electrical terminal block 201.

The relay holder 111 has a front guide rail 125 and/or a rear guide rail 207, in which the relay 101 at least partially engages, the front guide rail 125 and the rear guide rail 207 being adapted to guide the relay 101 along an insertion direction towards the socket 113, in order to achieve a superimposed alignment of the contact plug 107 to the socket 113.

Furthermore, the front guide rail 125 and/or the rear guide rail 207 each have a U-shaped profile which is adapted to form a positive connection with the relay 101 after and during the insertion of the relay 101 into the relay holder 111.

The relay 101 has a plurality of contact plugs 107 which are arranged in a row and project out of the bottom wall 103, wherein a first number of the contact plugs 107 form connection contacts 203-1, 203-2 of the relay 101 and a second number of the contact plugs 107 form switching contacts 205-1, 205-2 of the relay 101. Furthermore, the insulating wall 115 extends along the switching contacts 205-1, 205-2.

A section length 209 of the offset section 109 is smaller than a relay length 211 of the relay. In particular, the offset section 109 is sufficiently long to laterally limit the switching contacts 205-1, 205-2. Furthermore, a wall length of the insulating wall 115 is smaller than the section length 209 and the insulating wall 115 is adapted to form a form-fit connection with the offset section 109.

Figure 3:
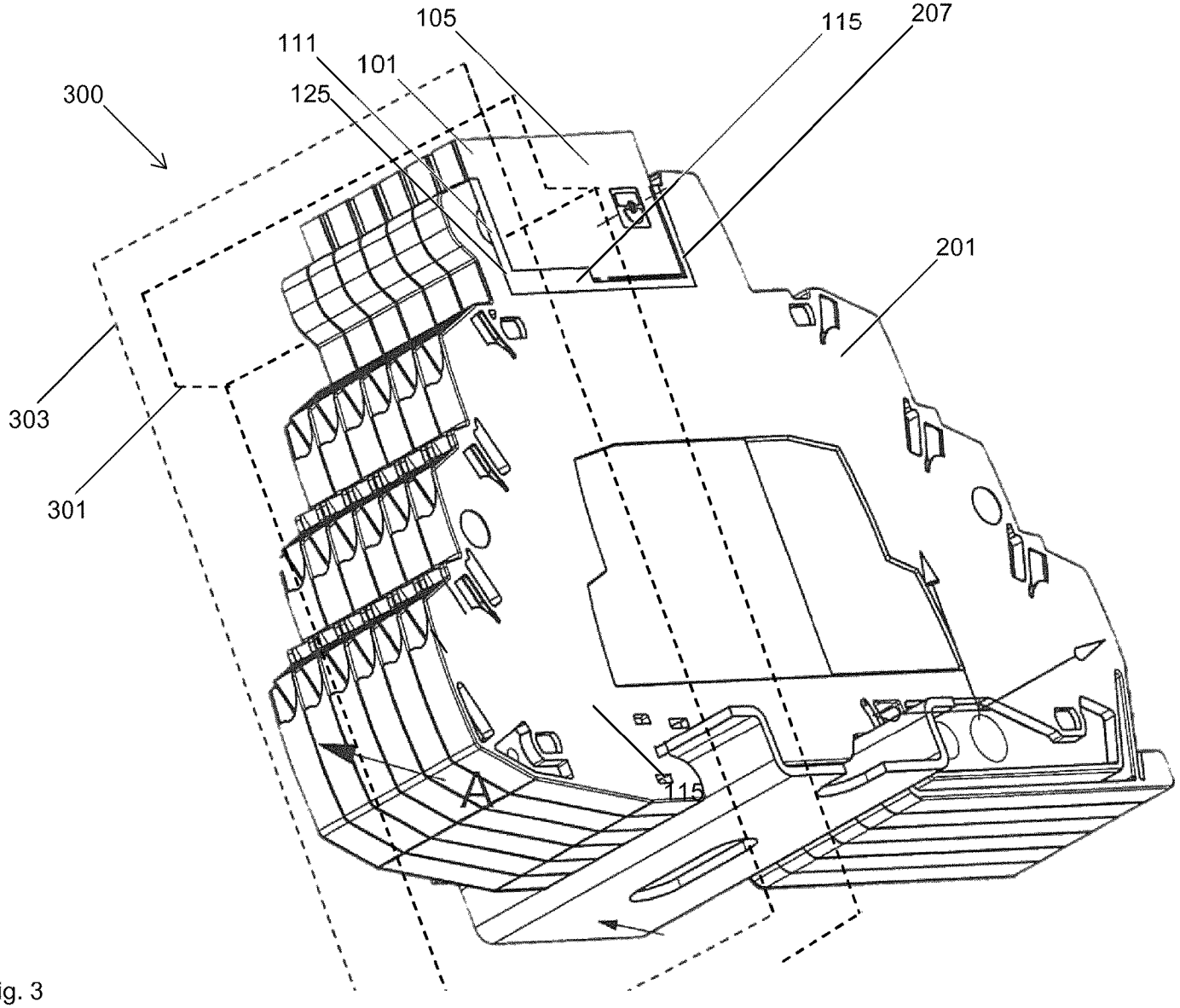
FIG. 3 shows an electrical terminal block arrangement in an example.

FIG. 3 shows an electrical terminal block arrangement 300 with a plurality of electrical terminal blocks 201, each of which has a plug-in connection arrangement 100 corresponding to the example shown in FIG. 1 and FIG. 2, each electrical terminal block 201 being adapted to hold a relay 101 which has a side wall 105. The respective electrical terminal block 201 has a relay holder 111 which is adapted to hold the respective relay 101, the relay holder 111 having an insulating wall 115 which is aligned parallel to the side wall 105 when the respective relay 101 is inserted into the relay holder 111 to form an angled insulation section along a surface of the insulating wall 115, wherein the electrical terminal blocks 201 are positioned congruently next to one another.

Furthermore, a first sectional plane 301 and a second sectional plane 303 are shown in the illustration, which are oriented transversely to a longitudinal direction of the relay 101. The first cutting plane 301 intersects the relay 101 in the area of the connection contacts and the second cutting plane 305 intersects the relay 101 and the relay holder 111 in the area of the insulating wall 115.

Figure 4A:
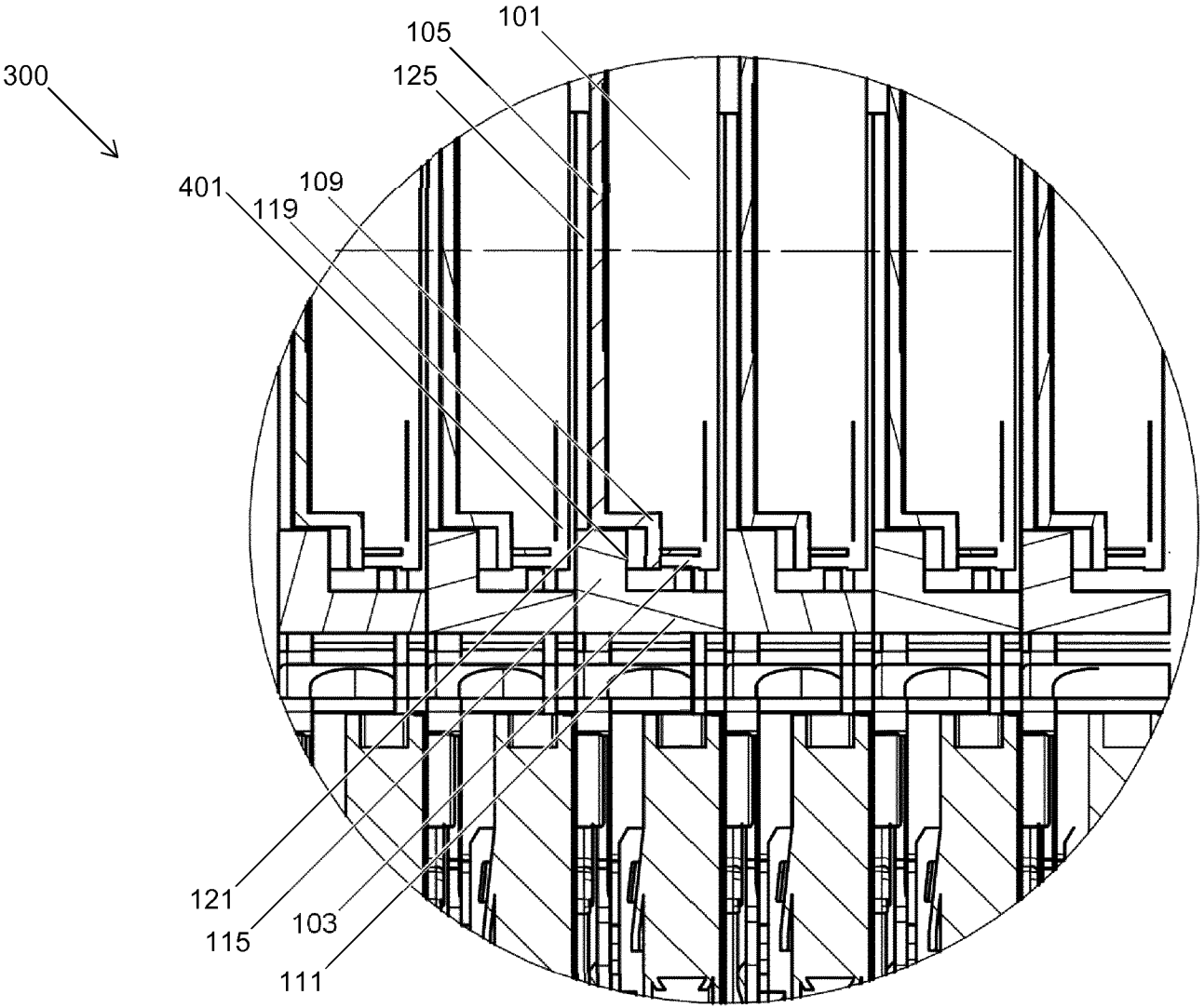
FIGS. 4A, 4B show an electrical terminal block arrangement in an example.

FIG. 4A shows a schematic cross-sectional view of the example of the electrical terminal block arrangement 300 shown in FIG. 3 along the cross-sectional plane 301 shown in FIG. 3. An insulation wall 115 of a plug-in connection arrangement 100 of a first electric terminal block of the plurality of electrical terminal blocks is arranged to a further outer wall 401 of a further plug-in connection terminal of a second electrical terminal block of the plurality of electrical terminal blocks and is faced towards the further outer wall 401. A gap is formed between the insulating wall 115 and the outer wall 127.

The insulating wall 115 at least partially engages in the offset section 109. Furthermore, the insulating wall 115 has a side wall surface 119 and a top surface 121, the side wall surface 119 facing the side wall 105 and being spaced apart from the offset section 109. The top surface 121 comes to bear at least partially on the offset section 109. Furthermore, the insulating wall 115 is offset in the direction of a surface normal of the side wall 105 with respect to the side wall 105 in order to form a cavity between the offset section 109 and the insulating wall 115.

Figure 4B:
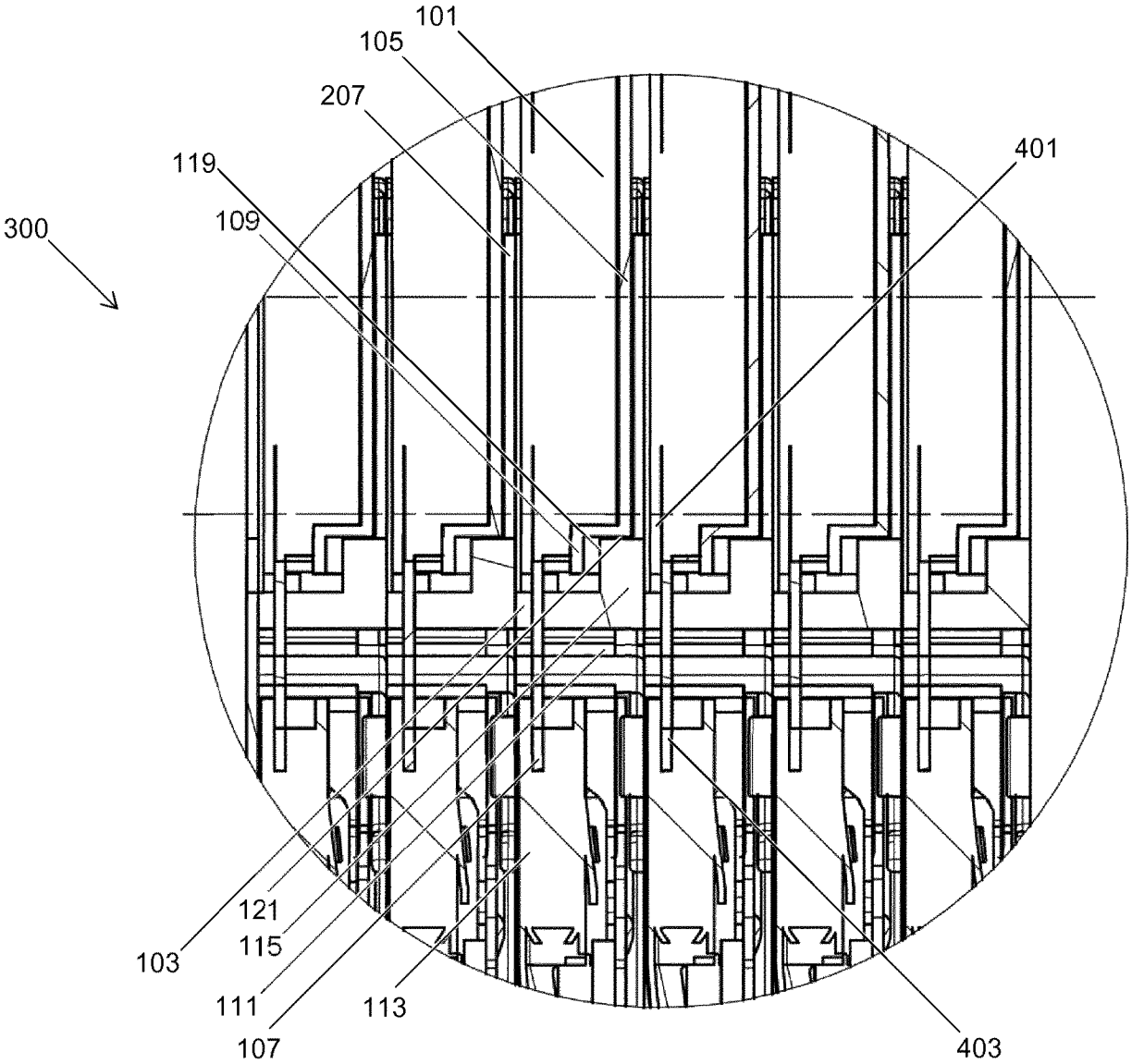

FIG. 4B shows a schematic cross-sectional view of the example of the electrical terminal block arrangement 300 shown in FIG. 3 along the cross-sectional plane 303 shown in FIG. 3. The insulation section extends alongside the wall surface 119 and the top surface 121 of the insulating wall 115.

A gap between the offset section 109, the insulating wall 115 of the first electrical terminal block and an outer wall 401 of the second electrical terminal block forms a multi-angled insulation section between the contact plug 107 of the plug-in connection arrangement 100 of the first electrical terminal block and the further contact plug 403 of the second electrical terminal block.

Figure 5:
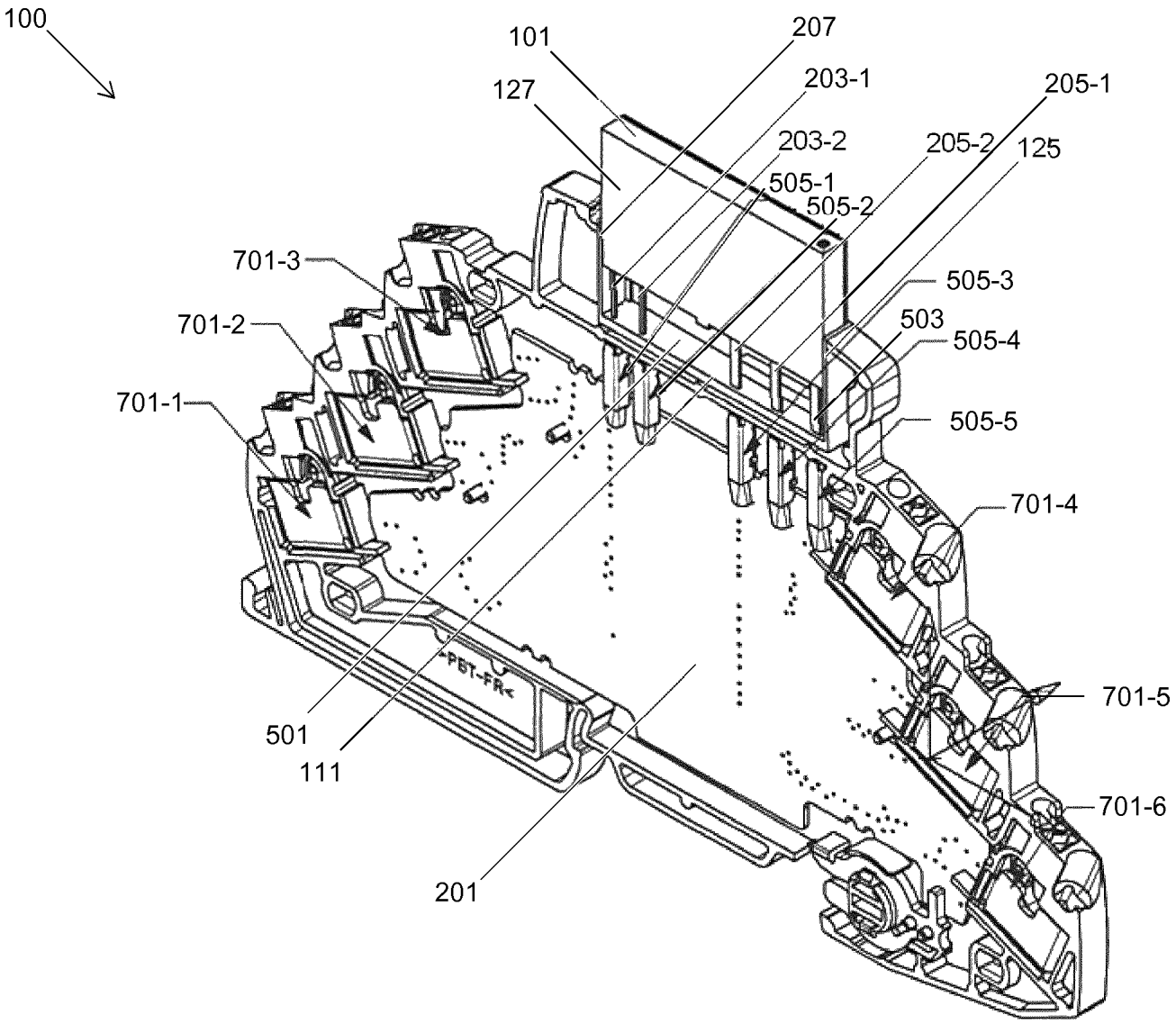
FIG. 5 shows a plug-in connection arrangement in an example.

FIG. 5 shows a schematic cross-sectional view of a plug-in connection arrangement 100 for arranging a relay 101 in an electrical terminal block 201. The electrical terminal block 201 has a relay holder 111 which is adapted to accommodate the relay 101. The relay 101 has a plurality of contact plugs which are arranged in a row and project out of the relay 101, wherein a first number of the contact plugs form connection contacts 203-1, 203-2 of the relay 101 and a second number of the contact plugs form switching contacts 205-1, 205-2, 503 of relay 101.

The relay holder 111 has a support plate 501 in which the plurality of sockets 505-1 to 505-5 is arranged, and wherein the support plate 501 is formed in one piece with the insulating wall 115. The plurality of sockets 505-1 to 505-5 is adapted, when the relay 101 is inserted into the relay holder 111, to receive the connection contacts 203-1, 203-2 and the switch contacts 205-1, 205-2.

The electrical terminal block 201 also has connection elements 701-1 to 701-6 which are adapted to guide the contact plugs of the relay, which are inserted into the sockets 505-1 to 505-5, to the outside. The connection elements 701-1 to 701-6 are adapted to receive a cable or a plug. In particular, the connection elements 701-1 to 701-6 can have a latching, screwing, clamping and/or plug-in connection for mechanically fixing and for electrically contacting a cable.

Figure 6:
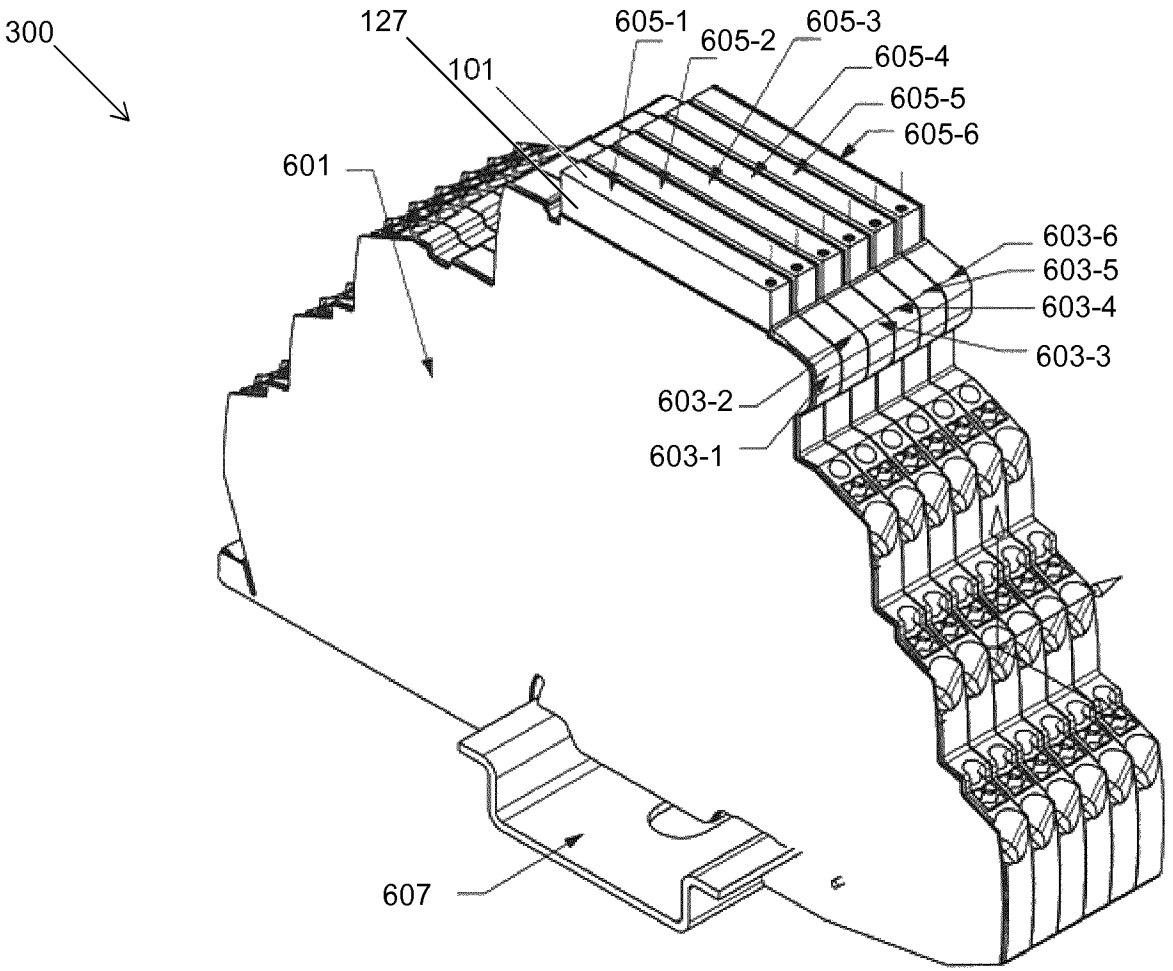
FIG. 6 shows an electrical terminal block arrangement in an example.

FIG. 6 shows an electrical terminal block arrangement 300 with a plurality of electrical terminal blocks 603-1 to 603-6, each of which has a plug-in connection arrangement corresponding to the example shown in FIG. 1 and FIG. 2, each electrical terminal block 603-1 to 603-6 being adapted for receiving a relay 605-1 to 605-6.

The electrical terminal block arrangement 300 comprises an end plate 601 which is arranged on the side of the relay 101 and rests on an outer wall 127 of the relay 101 opposite the side wall 105 in order to provide contact insulation and contact protection for the relay 101. The electrical terminal block arrangement 300 is arranged on a top hat rail 607, in particular pushed, clamped or latched onto the profile rail 607.

Figure 7:
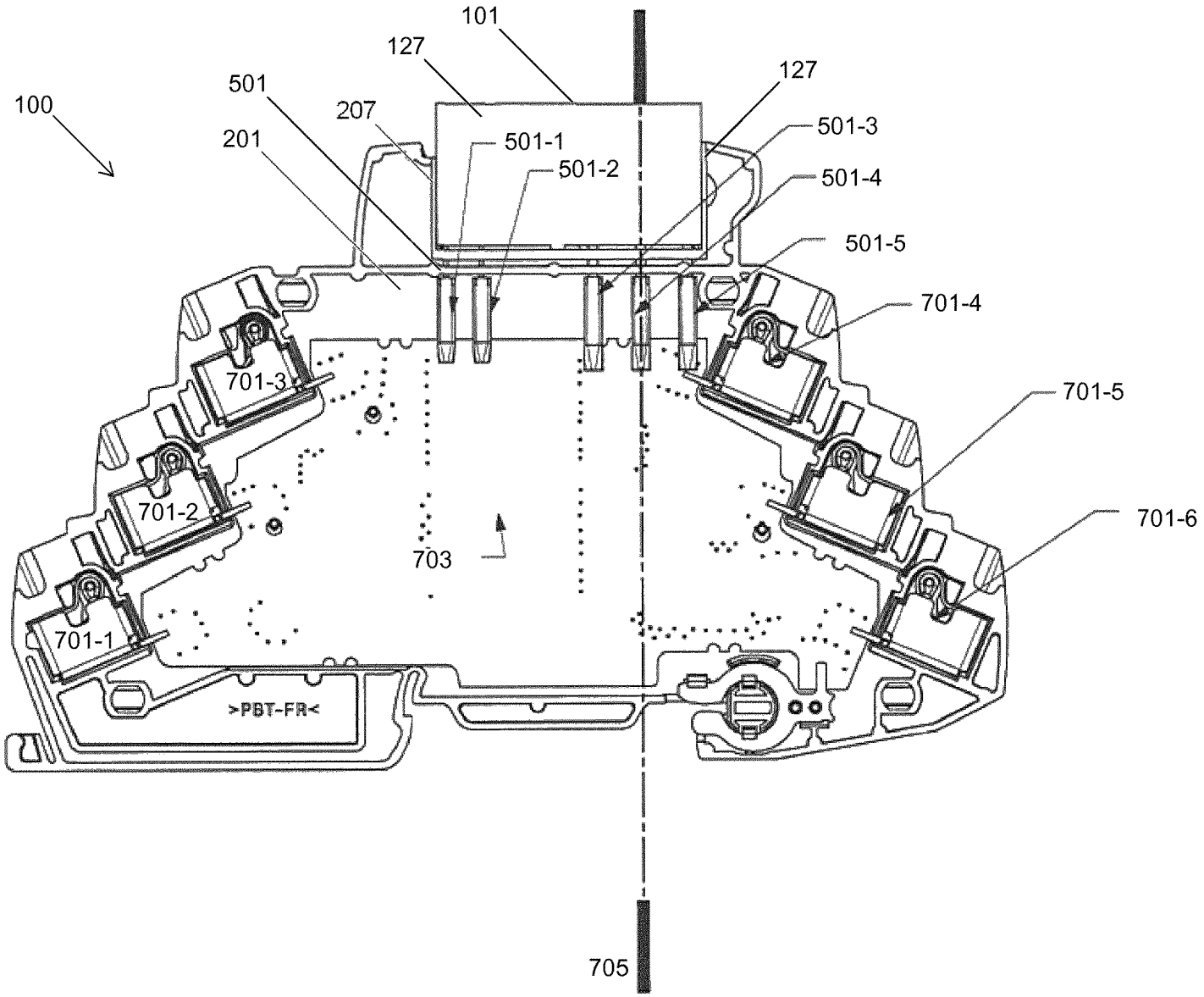
FIG. 7 shows a plug-in connection arrangement in an example.

FIG. 7 shows a schematic top view of the plug contact arrangement 100 according to the example shown in FIG. 5. The relay holder 111 has a support plate 501 in which the plurality of sockets 505-1 to 505-5 are arranged, and the support plate 501 is formed in one piece with the insulating wall 115. The plurality of sockets 505-1 to 505-5 are adapted to accommodate the connection contacts 203-1, 203-2 and the switching contacts 205-1, 205-2, 503, when the relay 101 is inserted into the relay holder 111.

The sockets 505-1 to 505-5 are soldered onto a printed circuit board 703 which is adapted to provide an electrical connection between the sockets 505-1 to 505-5 and connection elements 701-1 to 701-6. Alternatively, the use of lead frames as a connecting element between the sockets 505-1 to 505-5 and the connection elements 701-1 to 701-6 is possible. Furthermore, a cross-sectional plane 705 is shown in FIG. 7.

Figure 8:
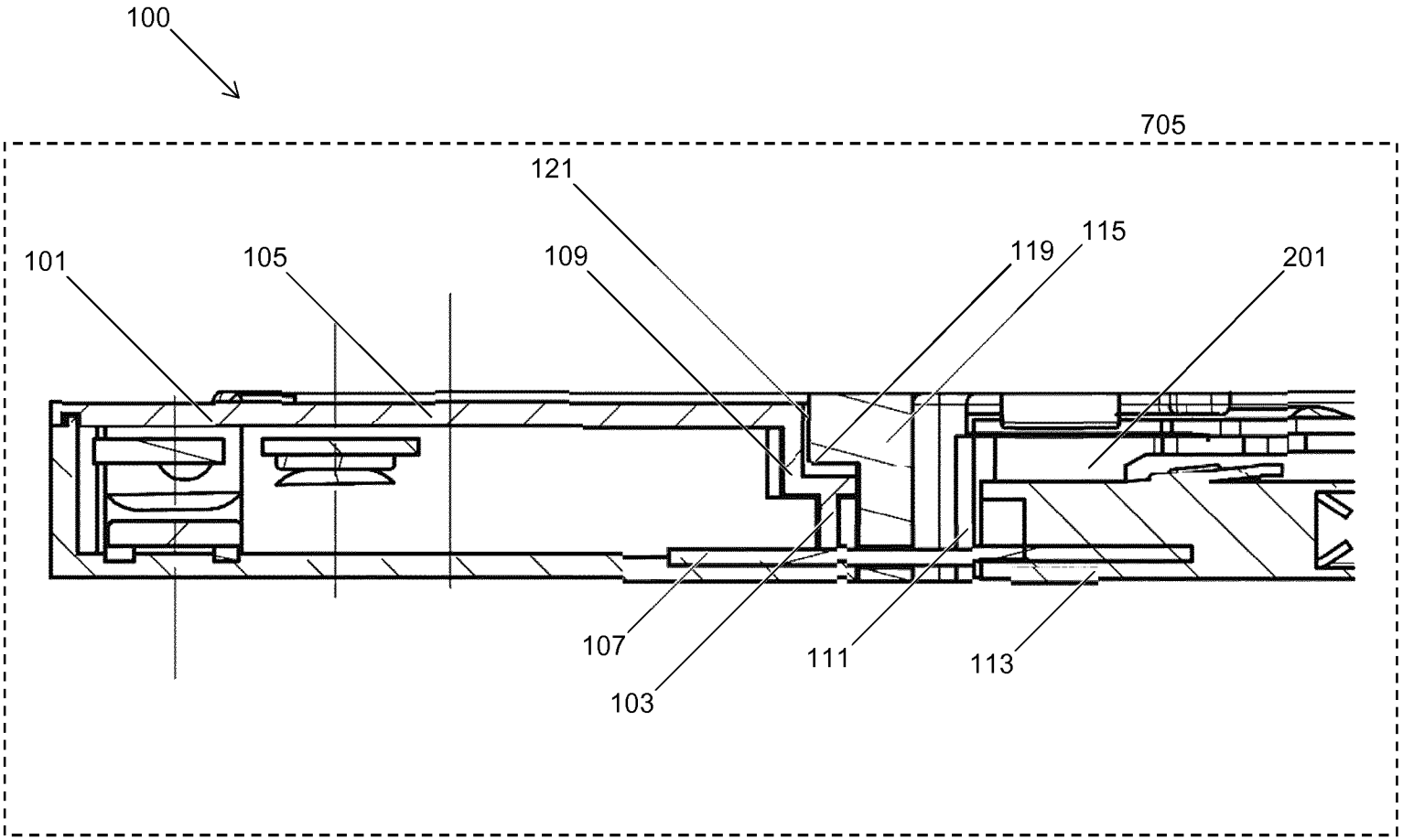
FIG. 8 shows a plug-in connection arrangement in an example.

FIG. 8 shows a schematic cross-sectional view of a plug-in connection arrangement 100 for arranging a relay 101 in an electrical terminal block 201 according to the example shown in FIG. 7 along the cross-sectional plane 705. The relay 101 has a bottom wall, a side wall 105 and a contact plug 107, which projects out of the bottom wall 103. The side wall 105 is arranged perpendicular on the bottom wall 103 and has an offset section 109 which adjoins the bottom wall 103 and projects into the relay 101 in the direction of a surface normal of the side wall 105.

The electrical terminal block 201 has a relay holder 111 which is adapted to hold the relay 101, the relay holder 111 having a socket 113 which is adapted to hold the contact plug 107 when the relay 101 is inserted into the relay holder 111.

The relay holder 111 also has an insulating wall 115 which, when the relay 101 is inserted into the relay holder 111, is aligned parallel to the side wall 105 and projects beyond the bottom wall 103 in order to form an angled insulation section for the contact plug 107 along a surface of the insulating wall 115.

The insulating wall 115 at least partially engages in the offset section 109 in order to reduce a structural width 117 of the plug-in connection arrangement 100. Furthermore, the insulating wall 115 has a side wall surface 119 and a top surface 121, wherein the side wall surface 119 faces the side wall 105 and is at a distance from the offset section 109, and wherein the top surface 121 comes to bear at least partially on the offset section 109. Furthermore, the insulating wall 115 is offset in the direction of a surface normal of the side wall 105 with respect to the side wall 105 in order to form a cavity between the offset section 109 and the insulating wall 115.

Figure 9:
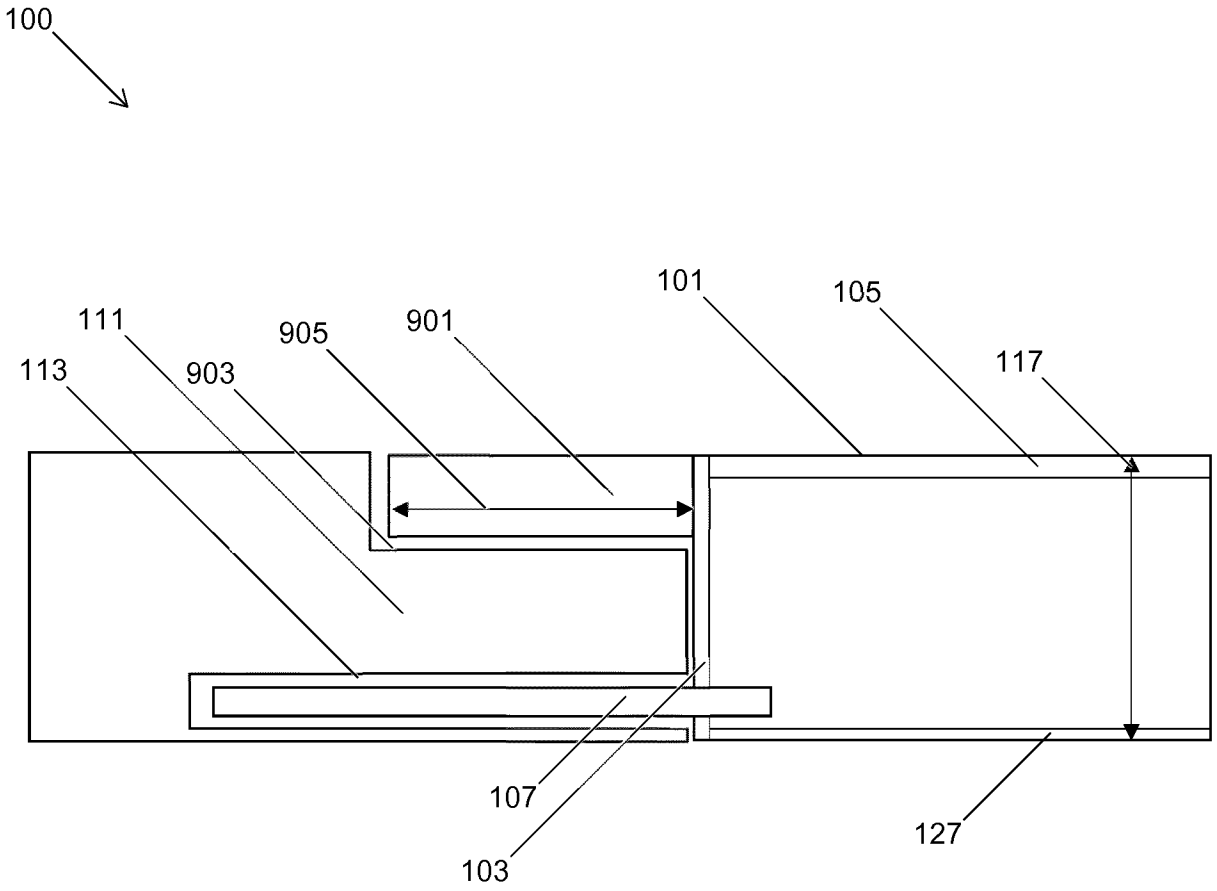
FIG. 9 shows a plug-in connection arrangement in an example.

FIG. 9 shows a schematic cross-sectional view of a plug-in connection arrangement 100 for arranging a relay 101 in an electrical terminal block. The relay 101 has a bottom wall 103, a side wall 105 and a contact plug 107 which projects out of the bottom wall 103. The side wall 105 is arranged perpendicular on the bottom wall 103.

The electrical terminal block has a relay holder 111 which is adapted to hold the relay 101, the relay holder 111 having a socket 113 which is adapted to hold the contact plug 107 when the relay 101 is inserted into the relay holder 111.

The relay 101 also has a contact insulation wall 901 which is arranged parallel to the side wall 105 and at least partially projects beyond the bottom wall 103. The relay holder 111 further has a receptacle niche 903 which, when the relay 101 is inserted into the relay holder 111, is aligned parallel to the side wall 105 and is adapted to at least partially hold the contact insulation wall 901 in order to form an angled insulation section for the contact plug 107 along a surface of the contact insulation wall 901.

The contact insulation wall 901 at least partially engages in the receiving niche 903 in order to reduce a width 117 of the plug-in connection arrangement 100. Furthermore, a wall height 905 of the contact insulation wall 901 can exceed a niche height of the receiving niche 903 in order to arrange the bottom wall 103 at a distance from the relay holder 111 after the relay 101 has been inserted into the relay holder 111. The relay 101 also has an outer wall 127 facing away from the side wall 105 and the contact insulation wall 901.

LIST OF REFERENCE NUMBERS

100 plug-in connection arrangement
101 relay
103 bottom wall
105 side wall
107 contact plug
109 offset section
111 relay holder
113 socket
115 insulating wall
117 width
119 side wall surface
121 top surface
123 wall height
125 front guide rail
127 outer wall
201 electrical terminal block
203-1 connection contact
203-2 connection contact
205-1 switching contact
205-2 switching contact
207 rear guide rail
209 section length
211 overall length of relay
301 cross-sectional plane
303 cross-sectional plane
401 outer wall
403 contact plug
501 support plate
503 switching contact
505-1 socket
505-2 socket
505-3 socket
505-4 socket
505-5 socket
601 end plate
603-1 electrical terminal block
603-2 electrical terminal block
603-3 electrical terminal block
603-4 electrical terminal block
603-5 electrical terminal block
603-6 electrical terminal block
605-1 relay
605-2 relay
605-3 relay
605-4 relay
605-5 relay
605-6 relay
607 profile rail
701-1 connection element
701-2 connection element
701-3 connection element
701-4 connection element
701-5 connection element
701-6 connection element
703 printed circuit board
705 cutting plane
901 contact isolation wall
903 receiving niche
905 wall height

What is claimed is:

1. A plug-in connection arrangement for arranging a relay, comprising:

a terminal block comprising a relay holder configured to hold a relay, wherein the relay comprises a bottom wall, a side wall, and a contact plug which projects out of the bottom wall, wherein the side wall is arranged perpendicular to the bottom wall and comprises an offset section which contacts the bottom wall and projects out into the relay in a direction of a surface normal of the side wall;

wherein the relay holder comprises a socket configured to hold the contact plug of the relay when the relay is inserted into the relay holder; and wherein the relay holder further comprises an insulating wall which, when the relay is inserted into the relay holder, is aligned parallel to the side wall and projects beyond the bottom wall to form an angled insulation section for the contact plug along a surface of the insulating wall.

2. The plug-in connection arrangement according to claim 1, wherein the insulating wall at least partially engages in the offset section to reduce a width of the plug-in connection arrangement.

3. The plug-in connection arrangement according to claim 1, wherein the insulating wall comprises a side wall surface and a top surface, wherein the side wall surface faces the side wall and is spaced apart from the offset section, and wherein the top surface comes to bear at least partially on the offset section.

4. The plug-in connection arrangement according to claim 1, wherein the relay holder comprises a front guide rail and a rear guide rail in which the relay at least partially engages, wherein the front guide rail and the rear guide rail are configured to guide the relay along an insertion direction to the socket to realize a superimposed alignment of the contact plug to the socket.

5. The plug-in connection arrangement according to claim 4, wherein each of the front guide rail and the rear guide rail comprises a U-shaped profile which is configured to form a form-fit connection with the relay after or during an insertion of the relay into the relay holder.

6. The plug-in connection arrangement according to claim 1, wherein a section length of the offset section is smaller than a relay length of the relay.

7. The plug-in connection arrangement according to claim 6, wherein a wall length of the insulating wall is smaller than the section length and the insulating wall is configured to form a form-fit connection with the offset section.

8. The plug-in connection arrangement according to claim 1, further comprising an end plate which is arranged laterally on the relay holder and at least partially rests on an outer wall of the relay opposite the side wall or faces the outer wall, wherein the end plate provides contact insulation and protection against contact of the contact plug.

9. The plug-in connection arrangement according to claim 1, further comprising a plurality of contact plugs arranged in a row and protruding out of the bottom wall, wherein a first number of the contact plugs form connection contacts of the relay and a second number of the contact plugs form switching contacts of the relay, and wherein the insulating wall extends along the switching contacts.

10. The plug-in connection arrangement according to claim 1, wherein a wall height of the insulating wall exceeds a section height of the offset section such that the bottom wall is arranged at a distance from the relay holder after an insertion of the relay into the relay holder.

11. The plug-in connection arrangement according to claim 1, wherein the insulating wall is offset in a direction of the surface normal of the side wall relative to the side wall such that a cavity is created between the offset section and the insulating wall.

12. The plug-in connection arrangement according to claim 1, wherein the relay holder comprises a support plate in which the socket is arranged, and wherein the support plate is formed in one piece with the insulating wall.

13. The plug-in connection arrangement according to claim 1, wherein the relay comprises a contact insulation wall which is arranged parallel to the side wall and at least partially projects beyond the bottom wall, and wherein the relay holder comprises has a receiving niche which, when the relay is inserted into the relay holder is aligned parallel to the side wall, wherein the receiving niche is configured to at least partially hold the contact insulation wall such that an angled insulation section for the contact plug is formed along a surface of the contact insulation wall.

14. An electrical terminal block arrangement, comprising:

a plurality of electrical terminal blocks, each electrical terminal block comprising a respective plug-in connection arrangement, wherein each terminal block of the electrical terminal block comprises a relay holder configured to hold a respective relay, each respective relay comprising a bottom wall, a side wall, and a contact plug which projects out of the bottom wall, wherein the side wall is arranged perpendicularly on the bottom wall and comprises an offset section which contacts the bottom wall and projects out into the relay in a direction of a surface normal of the side wall;

wherein each relay holder comprises a socket configured to hold the contact plug of the respective relay when the respective relay is inserted into the relay holder;

wherein each relay holder further comprises an insulating wall which, when the respective relay is inserted into the relay holder, is aligned parallel to the side wall and projects beyond the bottom wall to form an angled insulation section for the contact plug along one surface of the insulating wall; and wherein the electrical terminal blocks are congruently next to each other.

15. The electrical terminal block arrangement according to claim 14, wherein the insulating wall of the plug-in connection arrangement of a first electrical terminal block of the plurality of electrical terminal blocks is arranged next to an outer wall of a further plug-in connection arrangement of a second electrical terminal block of the plurality of electrical terminal blocks and faces the outer wall of the further plug-in connection arrangement of the second electrical terminal block, wherein a gap is formed between the insulating wall of the plug-in connection arrangement and the outer wall of the further plug-in connection arrangement of the second electrical terminal block.

16. The electrical terminal block arrangement according to claim 15, wherein a gap between the offset section, the insulating wall of the first electrical terminal block, and a further outer wall of the second electrical terminal block forms a multi-angled insulation section between the contact plug of the plug-in connection arrangement of the first electrical terminal block and a further contact plug of the second electrical terminal block.

* * * * *